US006050443A

United States Patent [19]

Tung

[11] Patent Number: 6,050,443

[45] Date of Patent: Apr. 18, 2000

[54] DOUBLE LAYER MUG

[76] Inventor: Kuang Pao Tung, 5F-6, No. 16, Lane 442, Yi Ping Road, Tainan, Taiwan

[21] Appl. No.: 09/251,714

[22] Filed: Feb. 17, 1999

[51] Int. Cl.[7] ..... B65D 6/10

[52] U.S. Cl. ..... 220/592.17; 220/592.28; 220/62.12; 215/13.1; 215/12.1

[58] Field of Search ..... 220/592.28, 592.27, 220/592.23, 592.26, 592.2, 592.17, 592.16, 703, 23.91, 23.87, 4.06, 919, 62.18, 62.12; 215/13.1, 12.1

[56] References Cited

U.S. PATENT DOCUMENTS

| | | | |
|---|---|---|---|
| 1,639,101 | 8/1927 | O'Brien et al. | 220/592.27 |
| 1,706,034 | 3/1929 | Moore | 215/12.1 |
| 1,721,311 | 7/1929 | Muenchen | 215/12.1 |
| 2,828,043 | 3/1958 | Hosford, Jr. | 220/592.27 |
| 3,766,975 | 10/1973 | Todd | 165/74 |
| 4,676,411 | 6/1987 | Simasaki | 215/12.1 |
| 4,789,073 | 12/1988 | Fine | 215/13.1 |

*Primary Examiner*—Stephen Castellano
*Attorney, Agent, or Firm*—Pro-Techtor International Services

[57] ABSTRACT

A double layer mug includes an outer layer, an inner layer, an annular ring, and a grip. The outer layer is transparent, having an engage member on an outer surface. The inner layer can endure high temperature, having an inner annular projection. Between the outer and the inner layer is formed a hollow layer for storing a cool agent therein. The annular ring has an annular aperture for an elastic ring to fit therein, and an inner inner wall and an outer wall defining the aperture contact with an upper mouth of the inner and the outer layer, with an annular groove formed in the inner wall to engage with the inner annular projection, with an engage member of the annular ring engaging the engage member of the outer layer. Thus, the double layer mug can endure very high temperature and has its hollow layer visible through the outer layer.

2 Claims, 4 Drawing Sheets

DOUBLE LAYER MUG

BACKGROUND OF THE INVENTION

This invention relates to a double layer mug, particularly to one possible to enduring high temperature, provided with an intermediate hollow layer containing decorative matters visible from outside to arouse attention and desire of consumers.

A known conventional double layer mug of Taiwan Patent No. 84212234 publicized on Dec. 12, 1996 includes an outer layer 1, an inner layer 2, an anti-leak gasket 3, and a bottom 4 as main components, as shown in a copy of the patent.

The outer layer 1 is made of plastic, having a center hollow, and an annular recess 10 in an inner surface near an upper edge, and a grip 11 fixed on an outer surface for holding the mug.

The inner layer 2 is made of a metal, fitted in the outer layer 1, and having an annular groove in an upper end.

The anti-leak gasket 3 is fitted in the annular groove 20 of the inner layer 2.

The bottom 4 is located at the lower end of the outer layer 1, having a plurality of triangular chocks 40 laid on an upper surface for positioning the inner layer 2.

Further, a cool agent is poured in an intermediate layer formed between the outer layer 1 and the inner layer 2, prevented from flowing in the inner layer 2 by means of the anti-leak gasket 3. Thus this double layer mug has a cooling function.

However, though the inner layer is made of a metal heat-enduring, the outer layer does not necessarily have a heat-enduring feature. Consumers may be attracted by the intermediate layer with decoration visible from outside. If the outer layer is made of transparent and heat-enduring plastic, its cost should be expensive, raising up the cost of the whole mug. Then consumers may buy mugs made of stainless steel instead of those made of plastic. Besides, if the outer layer 1 is made of opaque heat-enduring plastic, the mug may not be attractive to consumers because of impossibility to draw curiosity of consumers. Most conventional double layer mugs use transparent but not heat-enduring plastic, and when liquid of high temperature flows out to the outer layer 1, the edge of the outer layer 1 may release toxic gas to harm a use's health.

SUMMARY OF THE INVENTION

This invention has been devised to offer a double layer mug having function to contain liquid of high temperature without releasing toxic, and with an intermediate layer visible from outside.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
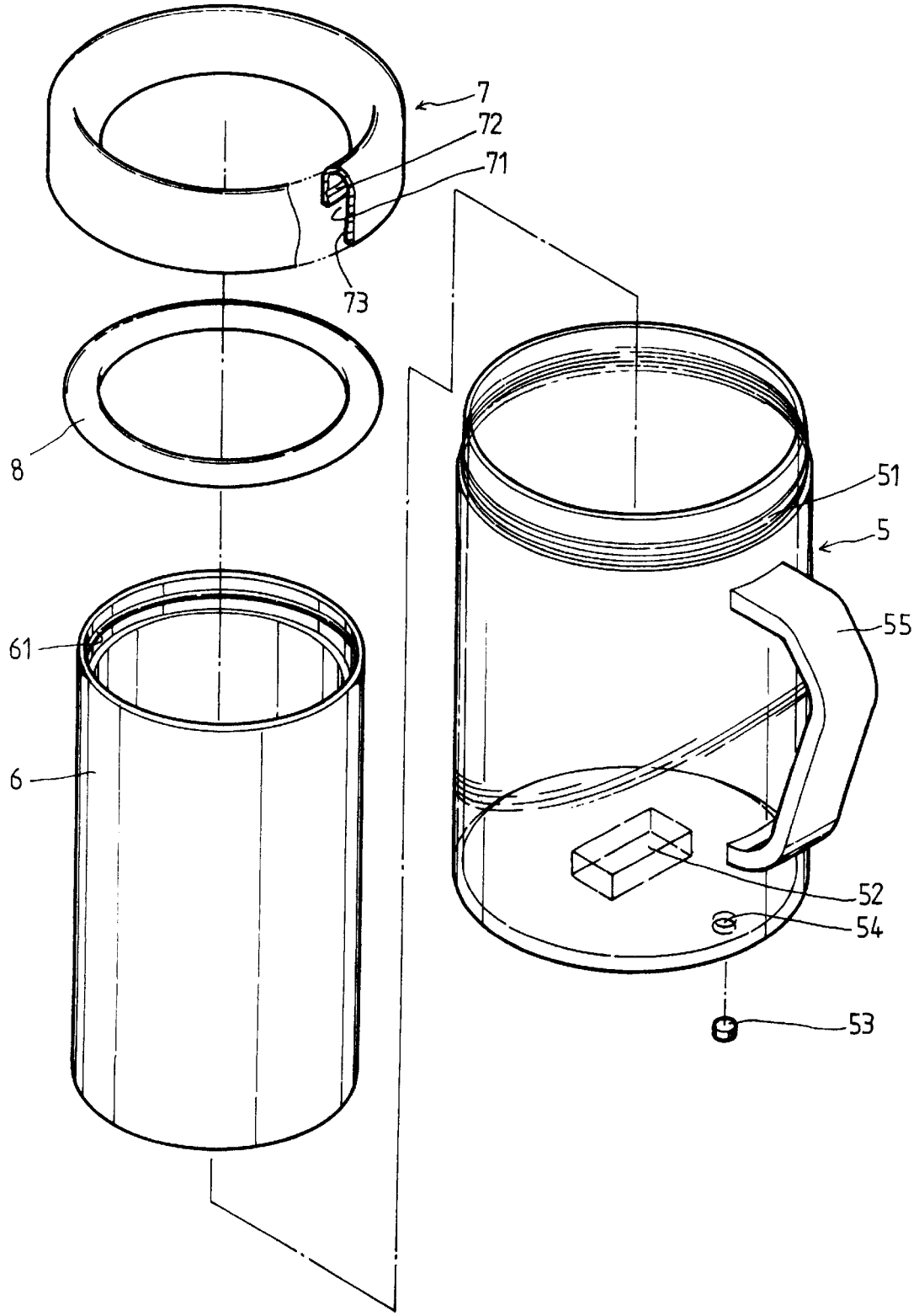
FIG. 1 is an exploded perspective view of a first embodiment of a double layer mug in the present invention.

A first embodiment of a double layer mug in the present invention, as shown in FIG. 1, includes an outer layer 5, an inner layer 6, an annular ring 7 with an annular aperture 71 defined by an outer and an inner wall respectively engaging with an upper edge of the outer layer 5 and the inner layer 6, an annular elastic member 8 buried in the annular groove 71 to help secure the annular ring 7 on the outer and the inner layer 5 and 6.

Figure 2:
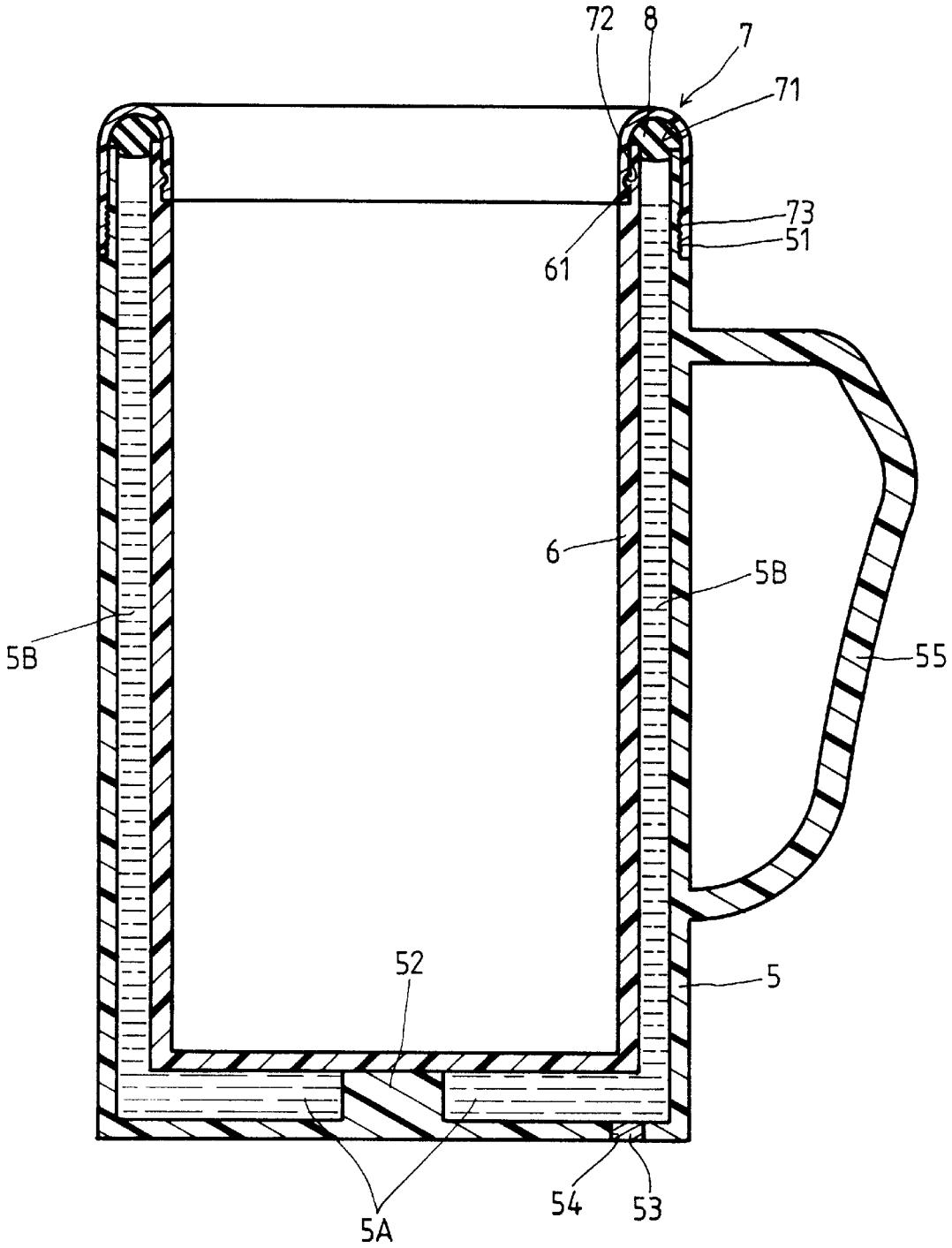
FIG. 2 is a cross-sectional view of the first embodiment of a double layer mug in the present invention.

The outer layer 5 is transparent, having not necessarily heat-enduring property and a combine means 51 (such as male threads) on an outer surface near an an upper mouth, for the outer wall of the annular ring 7 to engage to secure the ring 7 with the outer layer 5. Further, a separating block 52 is placed on the bottom of the outer layer 5 so as to form an intermediate hollow layer 5A between the outer layer 5 and the inner layer 6 after the inner layer 6 is positioned in the outer layer 5, as shown in FIG. 2. Further, a removable small stop 53 is provided to close a small hole 54 formed in the bottom. Besides, a grip 55 is fixed on an outer surface of the outer layer 5 for holding the mug.

The inner layer 6 is made of heat-enduring material such as a metal or proper plastic, for containing cold or hot liquid, having an annular projection 61 in an inner surface near an upper mouth to engage an annular groove 72 of an inner wall of the annular ring 7. ring 7. Further, the inner layer 6 and the outer layer 5 form two intermediate hollow layers 5A and 5B after the inner layer 6 is positioned in the outer layer 5, as shown in FIG. 2.

The annular ring 7 is made of a heat-enduring material, but not necessarily of transparent property, having the annular groove 72 formed in an inner wall defining the annular aperture 71 for the annular projection 61 of the inner layer 5 to engage with, and an outer wall defining the annular aperture 71 having an engage means (such as female threads) to coordinate with the engage means 51 of the outer layer 5.

Figure 3:
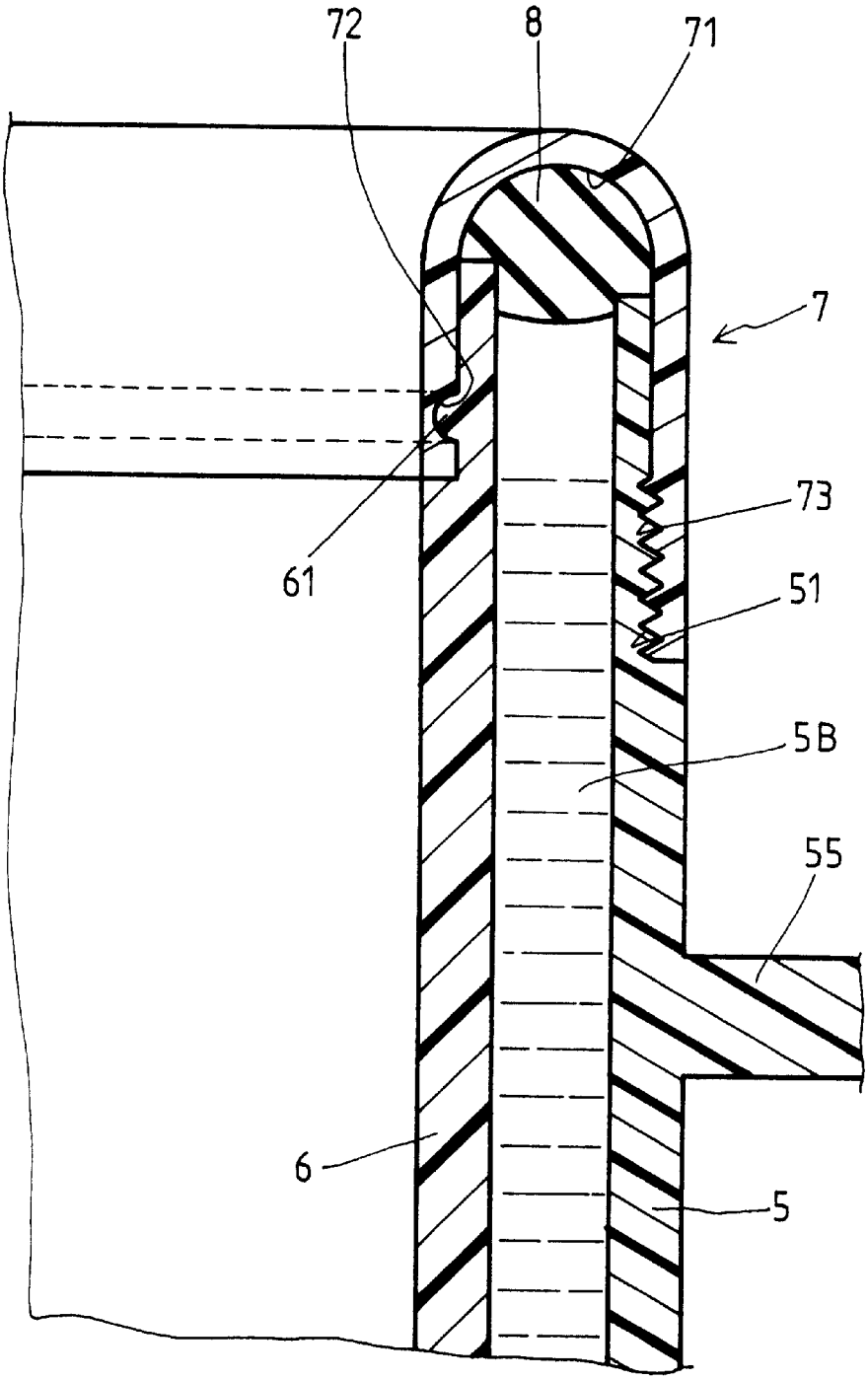
FIG. 3 is a partial enlarged cross-sectional view of the first embodiment of a double layer mug in the present invention; and, FIG. 4 is a side view of a second embodiment of a double layer mug in the present invention.

In assembling, referring to FIGS. 2 and 3, firstly the elastic ring 8 is fitted in the annular aperture 71 of the annular ring 7, with the annular groove 72 engaging with the annular projection 61 of the inner layer 6, and with the annular upper edge of the inner layer 6 urging tightly the elastic ring 8 in the annular ring 7 so that the elastic ring 8 may disfigure pushing the upper edge of the inner layer 6, securing stabilized the inner layer 6 and the annular ring 7. Then the engage member 73 of the annular ring 7 is made to engage or fused together by supersonic process with the engage member 51 of the outer layer 5 in a water-tight condition. Meanwhile, the outer layer 5 and the annular ring 7 are also tightly assembled by means of the compressed elastic ring 8. Between the outer layer 5 and the inner layer 6 are formed two intermediate hollow layers 5A and 5B communicating with each other, and a proper liquid such as a cool agent, water, color-changing liquid by temperature, etc. is poured the hollow layers 5A, 5B through the hole 54 and stopped with the small stop 53 fitted in in the hole 54.

In using, the inner layer 6 can be poured in with a very hot fluid, as the inner layer 6, the annular ring 7 are heat-enduring, and the whole mug can endure very high temperature, without any risk of producing any toxic gas from any part of the mug. In addition, the outer layer 5 can be seen through to satisfy visual curiosity of consumers.

Figure 4:
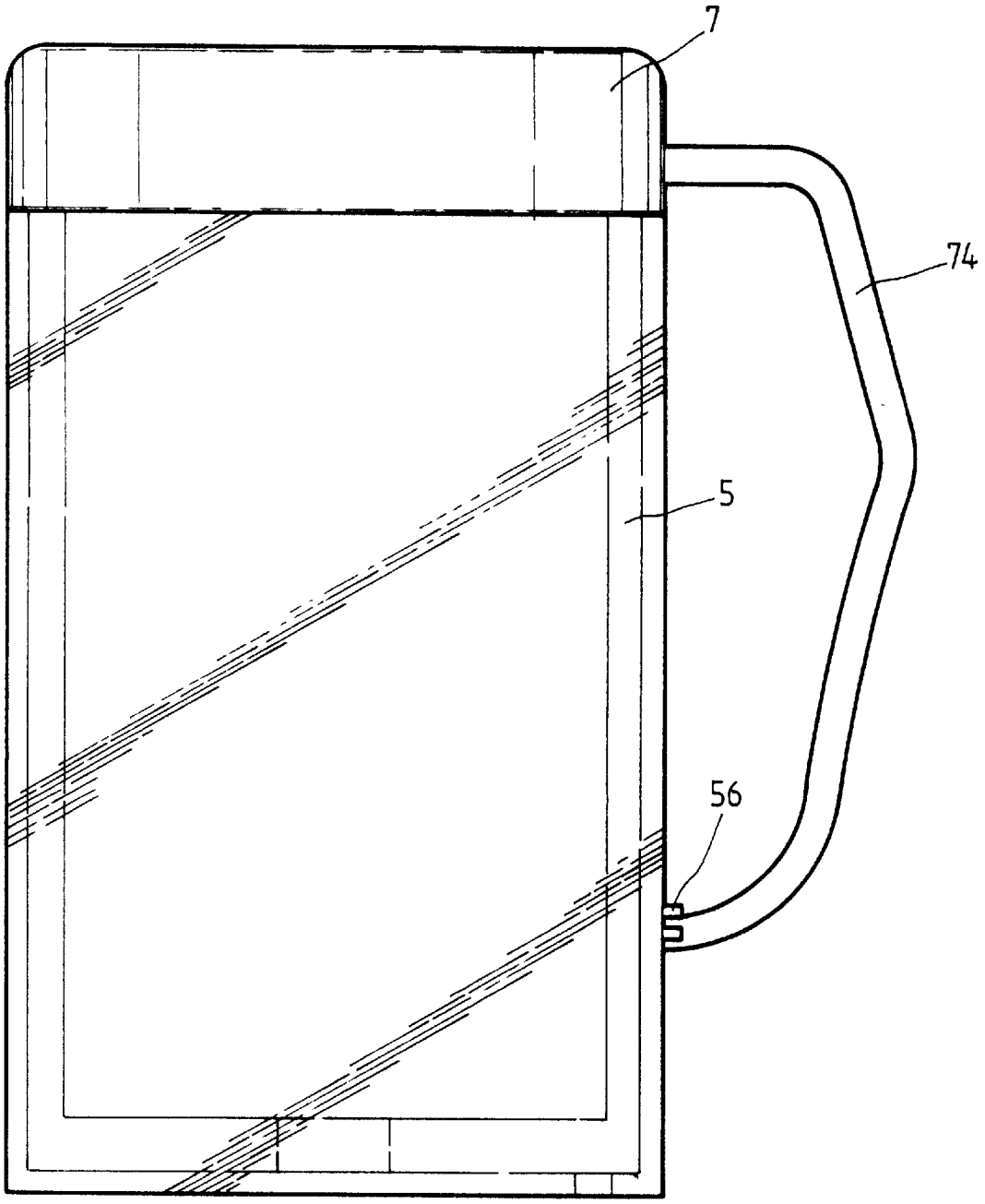

A second embodiment of a double layer mug shown in FIG. 4 has the same structure as the first embodiment, except that a grip 74 is formed to have an upper end fixed with the annular ring 7 and a lower end fixed with an outer surface of the outer layer 5, functioning the same as the first embodiment.

The double layer mug in the invention has the same components as the known conventional mug described above, but has a different structure, possible to endure very high and low temperature, increasing its practicality for consumers.

What is to be stressed in the present invention is that if the outer layer of the conventional double layer mug is made of transparent and heat-enduring material, its cost might be very expensive, and its transparency might be worse than the present invention. So the conventional double layer mug has only one function, as compared with two functions the present invention has, both heat-enduring function and transparency of the outer layer.

While the preferred embodiments of the invention have been described above, it will be recognized and understood that various modifications may be made therein and the appended claims are intended to cover all such modifications which may fall within the spirit and scope of the invention.

ENCLOSED: A copy of Taiwan patent No. 84212234.

I claim:

1. A double layer mug comprising:

an outer layer made of a transparent material, having an engage member formed on an outer surface near an upper mouth;

an inner layer made of a heat-enduring material, positioned in said outer layer, and having an annular projection in an inner surface near an upper mouth, a hollow layer formed between said inner layer and said outer layer;

an annular ring made of a heat-enduring material, having an annular aperture defined by an annular outer wall and an annular inner wall and facing down, an annular groove formed in said inner wall to engage with said annular projection of said inner layer, said outer wall having an annular engage member engaging with said engage member of said outer layer;

an elastic ring fitted in said annular aperture of said annular ring;

said elastic ring located in said annular ring compressed by the upper mouth of said inner layer and pushing tightly said upper mouth to secure stabilized said annular ring on said inner layer, said outer layer also secured stabilized by said elastic ring, thus said outer layer and said inner layer assembled together quite stabilized with said annular ring, said double layer mug possible to endure liquid of very high temperature and to be seen through said outer layer with said intermediate layer visible.

2. The double layer mug as claimed in claim 1, wherein a grip is provided to have an upper end directly fixed with said annular ring and a lower end fixed with a prop on said outer layer for holding said mug.

* * * * *